US009291177B2

(12) United States Patent
Wurz et al.

(10) Patent No.: US 9,291,177 B2
(45) Date of Patent: Mar. 22, 2016

(54) DUCT HAVING FLOW CONDUCTING SURFACES

(75) Inventors: Dieter Wurz, Baden-Baden (DE); Stefan Hartig, Achern (DE)

(73) Assignee: ESG mbH, Baden-Baden (DE)

( * ) Notice: Subject to any disclaimer, the term of this patent is extended or adjusted under 35 U.S.C. 154(b) by 398 days.

(21) Appl. No.: 13/701,751

(22) PCT Filed: May 31, 2011

(86) PCT No.: PCT/EP2011/058944

§ 371 (c)(1), (2), (4) Date: Jan. 7, 2013

(87) PCT Pub. No.: WO2011/151323

PCT Pub. Date: Dec. 8, 2011

(65) Prior Publication Data

US 2013/0265848 A1 Oct. 10, 2013

(30) Foreign Application Priority Data

| | | |
|---|---|---|
| Jun. 1, 2010 | (DE) | 10 2010 022 418 |
| Jun. 17, 2010 | (DE) | 10 2010 024 091 |
| Feb. 22, 2011 | (DE) | 10 2011 012 039 |

(51) Int. Cl.

| | |
|---|---|
| ***F15D 1/02*** | (2006.01) |
| ***F04D 29/54*** | (2006.01) |
| ***F15D 1/00*** | (2006.01) |
| ***F04D 29/68*** | (2006.01) |
| *B01F 15/00* | (2006.01) |

(52) U.S. Cl.

CPC ..... *F15D 1/025* (2013.01); *F04D 29/541* (2013.01); *F04D 29/545* (2013.01); *F04D 29/681* (2013.01); *F04D 29/684* (2013.01); *F15D 1/001* (2013.01); *B01F 15/00915* (2013.01)

(58) Field of Classification Search

CPC ..... B01F 5/0451; F01D 29/542; F15D 1/04; F15D 1/0005; F15D 1/001; F15D 1/025; F04D 29/681; F04D 29/684

USPC ..... 366/336, 338

See application file for complete search history.

(56) References Cited

U.S. PATENT DOCUMENTS

| | | | |
|---|---|---|---|
| 1,940,790 | A | 12/1933 | Diehl |
| 2,650,752 | A | 9/1953 | Hoadley |
| 2,813,708 | A | 11/1957 | Frey |

(Continued)

FOREIGN PATENT DOCUMENTS

| | | | |
|---|---|---|---|
| DE | 3534268 | A1 | 4/1987 |
| DE | 42 41 614 | A1 | 6/1994 |

(Continued)

OTHER PUBLICATIONS

International Search Report for International Patent Application No. PCT/EP2011/058944 mailed on Nov. 30, 2011.

*Primary Examiner* — Tony G Soohoo

(74) *Attorney, Agent, or Firm* — Larson & Anderson, LLC

(57) ABSTRACT

A duct in which a fluid can be conducted is bound by duct walls, wherein the duct walls have an inlet opening and an outlet opening through which the fluid can enter the duct and exit the duct. The fluid has a flow velocity which is smaller along the duct walls than at the duct middle, so that a zone of higher flow velocity and a zone of lower flow velocity can be formed in the duct. A flow guide surface is arranged in the duct by means of which a portion of the fluid can be taken from the zone of higher flow velocity and can be mixed into the zone of lower flow velocity.

7 Claims, 12 Drawing Sheets

(56) References Cited

U.S. PATENT DOCUMENTS

Figure 1:
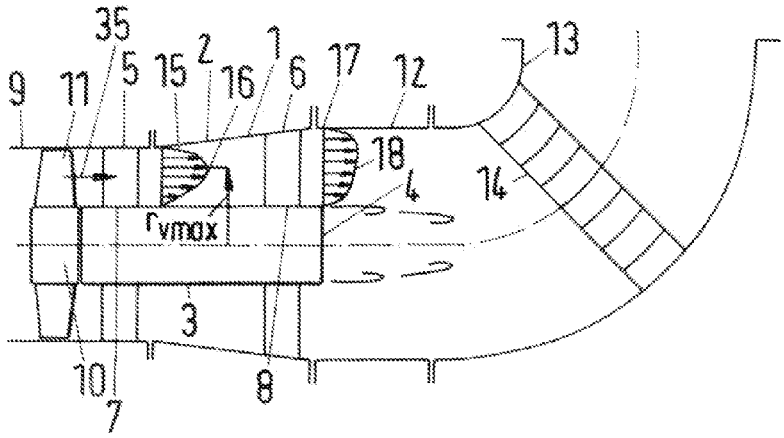

| | | | | |
|---|---|---|---|---|
| 4,270,576 | A * | 6/1981 | Takeda et al. | 137/888 |
| 5,014,609 | A | 5/1991 | Weck | |
| 5,077,967 | A * | 1/1992 | Widener et al. | 60/772 |
| 5,335,501 | A | 8/1994 | Taylor | |
| 6,554,569 | B2 * | 4/2003 | Decker et al. | 415/192 |
| 7,444,802 | B2 | 11/2008 | Parry | |
| 8,033,714 | B2 * | 10/2011 | Nishioka et al. | 366/163.2 |
| 2006/0102799 | A1 | 5/2006 | Liebe et al. | |
| 2009/0103393 | A1 * | 4/2009 | Moser et al. | 366/152.1 |

FOREIGN PATENT DOCUMENTS

| | | | |
|---|---|---|---|
| DE | 4325977 | A1 | 2/1995 |
| DE | 19757187 | A1 | 6/1996 |
| DE | 698 11 869 | T2 | 4/2003 |
| DE | 102 37 341 | A1 | 2/2004 |
| DE | 102006048933 | A1 | 4/2008 |
| EP | 0 414 021 | A2 | 2/1991 |
| EP | 0 585 194 | A1 | 3/1994 |
| EP | 0 638 732 | A1 | 2/1995 |
| EP | 0 789 195 | A1 | 8/1997 |
| EP | 0 863 364 | A2 | 9/1998 |
| EP | 0 926 356 | A2 | 6/1999 |
| FR | 2 165 330 | A5 | 8/1973 |
| JP | 63105300 | A | 5/1988 |
| JP | 06-307640 | | 11/1994 |
| WO | 98/41739 | A1 | 9/1998 |
| WO | 2008-046389 | A1 | 4/2008 |

* cited by examiner

A-B

DUCT HAVING FLOW CONDUCTING SURFACES

The present application is a National Stage of International Application No. PCT/EP2011/058944, filed on May 31, 2011, which claims priority to German Patent Application No. 10 2010 022 418.9 filed on Jun. 1, 2010, German Patent Application No. 10 2010 024 091.5 filed on Jun. 17, 2010, and German Patent Application No. 10 2011 012 039.4 filed on Feb. 22, 2011, the entire contents of which are being incorporated herein by reference.

In many process engineering plants the problem arises of how to homogenize flow fields and state fields in fluid flows. A reason for this lies in that the inhomogeneity of the velocity distribution of a fluid behind a plant component can lead to increased pressure losses or, however, to vibration excitations in subsequent plant parts. Furthermore, corrosion damages can be caused by inhomogeneous temperature fields and concentration fields in fluids. For this reason the aim also exists in some cases to homogenize the field of the state variables in a flowing fluid, independently of the problem of a homogenization of the velocity distribution. In the following we will refer to this fluid as a primary fluid.

It can further be necessary to mix gas like additives or also particular additives suspended in a support gas, which we refer to as a second fluid, as homogenously as possible into the basic flow of a primary fluid. Albeit a hot gas merely having to be mixed into a primary fluid as a secondary fluid in some cases, for example, in order to reduce a loading of the primary fluid with droplets by evaporation. In many cases of application only a comparatively short running path of the flow of the primary fluid is available for the accomplishment of this mixing-task. It is known that the pressure loss which the primary fluid experiences in a mixer is generally so much higher the shorter the available mixing path is.

A solution to this problem is provided by means of the invention in order to achieve the homogenization of flow fields and state fields within a relatively short running path for as few total pressure losses as possible or in many cases even on achieving a recovery of pressure. In this respect recovery of pressure is understood by us to mean an increase of the mean statistical pressure in the primary fluid flow.

STATE OF THE ART

In the following we will orientate ourselves on the situation which is frequently found downstream of a large axial blower 9 in accordance with the state of the art, FIG. 1. As a rule, a ring diffuser 1 is connected to the blower running wheel 10 having the running vanes 11 there. The relatively high downstream speed 35 of the primary fluid having a cross-sectional mean of approximately 80 to 100 m/s should be reduced in this diffuser while recovering pressure and the velocity distribution should be homogenized.

In this connection the ring diffuser 1 is composed of a weakly extending conical housing 2 and a cylindrical inner body 3, also referred to as hub body, which has a blunt end surface 4 so that an erratic increase in cross-section can be produced in this connection which corresponds to a Carnot impact diffuser.

The hub body 3 is centered in two axial positions 7 and 8 via more or less star-shaped radially aligned sheet metal parts 5 and 6. In this respect the sheet metal parts 5 can be designed as curved post guide vanes of the blower with the aim to reduce the twist in the outflow of the primary fluid from the vane blades and to thereby achieve a substantially axial through-flow of the subsequent components. In this example a short cylindrical duct section 12, as well as a 90°-manifold 13 is associated with the ring diffuser 1. The manifold is equipped with a guide grid 14. Moreover, since an aerodynamically optimized manifold guide grid has a relevant pressure loss it acts as a throttle grid homogenizing the flow field in many situations.

The axial velocity distribution 15 of the primary fluid has relatively high over-speeds at the inlet into the ring diffuser 1 behind the guide vane 11 of an axial blower, in particular for high aerodynamic loads, wherein the velocity maximum 16 is displaced to a larger radius r. In the slender ring diffuser 1 illustrated in the present example a homogenization of the velocity distribution is brought about by the internal friction in the highly turbulent flow field of the primary fluid and therefore brings about a reduction of the velocity maximum 16. A turbulent equilibrium-velocity profile would be formed following a very long running path of the flow, which is characterized by large velocity gradients in the wall vicinity. Sometimes one talks of a substantially box-shaped section and/or of a block section. The velocity profile 18 illustrated at the outlet 17 of the ring diffuser 1 has indeed not yet taken on the form of a turbulent equilibrium-velocity profile, but has already approached this quite significantly. The velocity maximum 16 of the starting profile 15 is substantially reduced and the transfer of the profile 15 into the profile 18 leads to an increase of the static pressure in the flow direction of the primary fluid, in accordance with a common way of expression, to a recovery of pressure, although the process of the flow delay is naturally associated with a total pressure loss.

Figure 2:
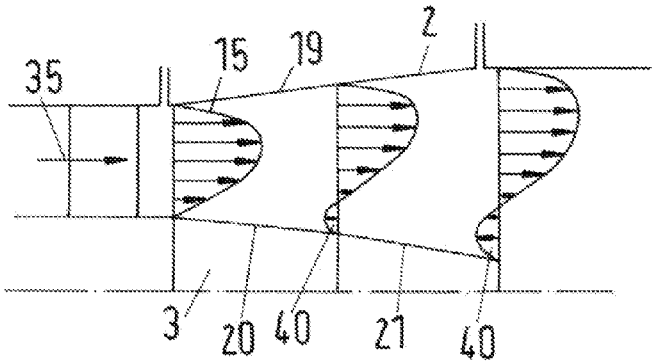

FIG. 2 shows a second ring diffuser configuration 19 in accordance with the state of the art, this being characterized by a substantial cross-sectional increase in the flow direction of the primary fluid. In this example, the outer boundary 2 is designed as a spherical weakly diverging housing, as was already the case for the configuration in accordance with FIG. 1. Additionally the hub body 3 is convergently designed in two sections 20 and 21 in flow direction as can also be found in expert literature. The flow adjacent the hub body does not cope with the pressure increase in the flow direction in the example illustrated in this connection and this brings about a flow separation with back flow zones 40, the velocity distribution 15 illustrated in this example being characterized by low flow velocities in the wall vicinity, or more precisely, by low velocity gradients and therefore by a small wall shear stress TW. In this case a small recovery of pressure is achieved at best. The slender diffuser in accordance with FIG. 1 can then be superior from a flow dynamics point of view with regard to the achievable recovery of pressure.

Figure 3:
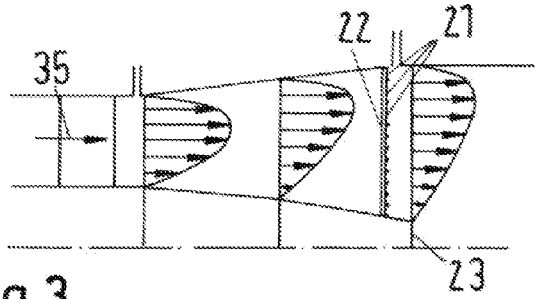

FIG. 3 shows a further configuration which differs from that of FIG. 2 in that a throttle grid 22, which can be built-up of rods 24, is installed in the region of the rear end 23 of the hub body. The flow separation at the hub can be prevented, by means of the retro-active effect of the throttle grid onto the flow of the primary fluid. This throttle grid can be configured as a so-called gradient grid, whereby a matching to the velocity distribution of the flow of the primary fluid at the inlet into the ring diffuser is possible. Should flow separations still take place in an intermediate section albeit the throttle grid being installed, then the flow to the throttle grid occasionally nestles up to the field boundaries.

Such a throttle grid suffers from two negative properties: It generates a considerable pressure loss. It only causes a small space mixing which comparatively corresponds to the mesh width of the grid. The essential advantage lies in a homogenization of the velocity distribution upstream of the subsequent components so that, for example, the pressure loss in a subsequent manifold or in a register of profiled sound attenuating inserts can be significantly reduced.

From the previously discussed circumstances, as they can be monitored in diffusers in accordance with the state of the art, the task of the present invention follows: Zones with flow separations should be substantially prevented also in a short diffuser having a relatively strong cross-sectional increase. A large areal mixing in the flow of the primary fluid should be caused. An as high as possible recovery of pressure is to be achieved.

In this respect it should be considered that an additional mixer must be installed in the duct behind a blower in many cases for plants in accordance with the state of the art; this mixer actually generates an additional pressure loss. When this mixer can be omitted because of the mixing effect of the novel diffuser configuration in accordance with the invention this is to be evaluated as a beneficial effect of the new diffuser configuration. Finally, it is all about the overall pressure loss which has to be spent in order to achieve a predetermined aim.

In many process engineering plants the problem arises of how to homogenize flow fields and state fields in fluid flows. A reason for this lies therein that the inhomogeneity of the velocity distribution of a fluid behind a plant component can lead to increased pressure losses or, however, to vibration excitations in subsequent plant parts. Furthermore, corrosion damages can be caused by inhomogeneous temperature fields and concentration fields in fluids. For this reason the aim also exists in some cases, independent of the problem of a homogenization of the velocity distribution, to homogenize the field of the state variables in a flowing fluid, which is referred to as primary fluid 41 in this connection. The primary fluid can include a liquid or a gas or a mixture.

It can further be necessary to mix gas like additives or also particular additives suspended in a support gas, which we refer to as a second fluid, as homogenously as possible into the basic flow of a primary fluid. Albeit a hot gas merely having to be mixed into a primary fluid as a secondary fluid in some cases, for example, in order to reduce a loading of the primary fluid with droplets by evaporation. In many cases of application only a comparatively short running stretch of the flow of the primary fluid is available for the accomplishment of this mixing-task. It is known that the pressure loss which the primary fluid experiences in a mixer is generally so much higher the shorter the available mixing path is.

A solution to this problem is provided by means of the invention in order to achieve the homogenization of flow fields and state fields within a relatively short running path for as few total pressure losses as possible or in many cases even on achieving a recovery of pressure. In this respect recovery of pressure is understood by us to mean an increase of the mean statistical pressure in the primary fluid-flow. The total pressure naturally reduces in the flow direction, as long as no compaction work is supplied. In particular extended duct sections come into question as a field of application in which the flow velocity of the primary fluid 41 should be reduced from relatively high values of, for example, 80 m/s to low values of, for example, 10 m/s. Duct manifolds having an extended cross-section or varying cross-section are a further case of application of the basic principles of the present invention.

The invention further relates to a duct which includes a flow guide surface.

In the German patent applications DE 10 2010 022 418 and DE 10 2010 024 091, whose content is defined as an integral part of this application, the basic considerations for the optimization of diffusers, in particular behind large axial blowers is illustrated. In the course of a further intensive dealing with the problem being faced, further embodiments were developed which provide significant advantages with respect to a large-scale technical implementation.

It also known that an accelerated increase of the thickness of the flow boundary layer arises at the solid boundary of a flow field with an increased pressure at said boundary. This has the consequence of an insufficient supply of an impact from the "healthy" impulse-rich out flow on the flow zone at the vicinity of the wall. From several patent applications, such as e.g. U.S. Pat. No. 2,650,752 A, DE 19757187 A1, JP 63105300 A, DE 4325977 A1, DE 3534268 A, DE 102006048933 A1 it is principally known that the flow separation at the walls of the diffuser can be prevented with the introduction of an impact at the flow boundary layer or can be displaced down-stream. However, the question arises of how this introduction of impact should take place, so that as little as possible flow energy is consumed. In this respect a further field of development can even be provided.

Figure 4:
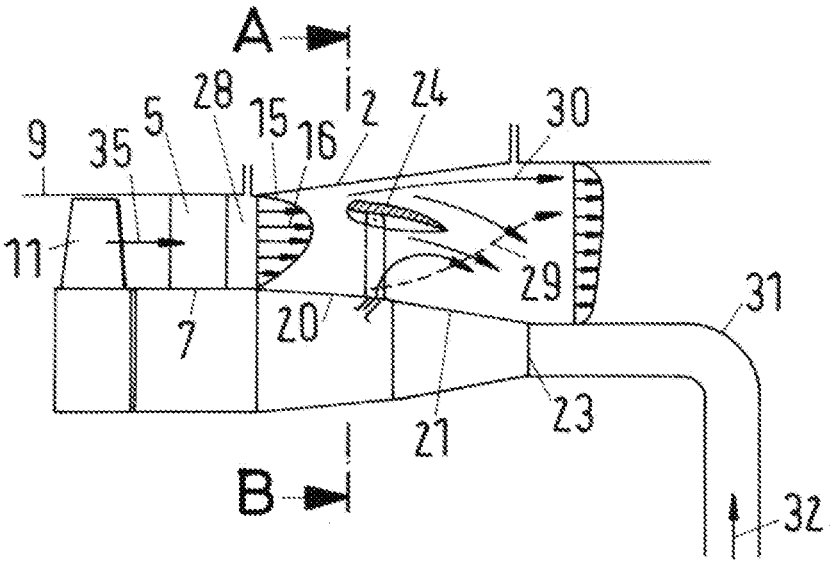

In FIG. 4 of the German patent application DE 10 2010 022 418 wing-like guide elements are illustrated at approximately half the diffuser length which cause an improved supply of the flow field close to the hub with impact from zones remote from the walls which have higher flow velocities, without too large a twist resulting in the flow. Rather the fluid is taken from a zone having a high flow velocity with the aid of aerodynamically optimized guide elements as friction-free as possible and is introduced as a turbulent-poor over-speed beam into the impact-weak zones. This basic principle can naturally also be applied to supply the boundary layer at the outer wall of the diffuser with an impact if this should be necessary. Indeed this is generally not required in view of the avoidance of a flow separation at the housing wall. However, an as homogeneous as possible velocity profile should be achieved at the inlet into the duct extension which follows the blower diffuser, it is sensible to accelerate the wall boundary layer at a housing through injection of partial amounts of the impulse-rich flow remote from the wall.

The problem of ensuring an as uniform as possible flow to the subsequent components is significantly simplified by a homogeneous velocity profile at the inlet into the strong duct extension which is subsequent to a slender blower diffuser in many fields of application. Furthermore, it is already achieved in the diffuser that the mass flow-weighted mean dynamic pressure at the diffuser exit is small because of the homogenization of the flow field. Thus, a high recovery of static pressure can principally be achieved by means of such a diffuser. A prerequisite for this is, however, that the measures which have to be taken for the homogenization of the velocity distribution are themselves not associated with a high pressure loss. This aim should be achieved with as few pressure losses as possible. Measures which are associated with a strong twisting of the flow cause high pressure losses and for this reason are less suitable for the boundary layer acceleration. This is also probably the reason why the suggestions provided in older patents and/or patent applications have so far not resulted in application at least not in general application. In this respect, in particular U.S. Pat. No. 2,650,752 A and DE 4325977 A1 should be mentioned. In DE 4325977 A1 the characterizing feature of the generation of a front edge twist at the installation surfaces in the diffuser is explicitly mentioned in claim 1. In the present patent application measures are suggested which do without a strong twisting of the flow in the high speed zones.

The situation at the outlet of large axial blowers shall initially be discussed briefly in order to make the suggestions included in the present invention more easily understandable. It has been known for a long time that the distribution of the axial speed behind the post guide wheel of an axial blower composed of a plurality of guide vanes already has a considerable inhomogeneity and a relevant boundary layer thickness. The fact that the axial velocity distribution at the outlet of an axial blower, expressed more precisely, the axial velocity distribution directly downstream of the post guide vane of such a blower, has a significant maximum in a coaxial section in this regard, FIG. 1 of the patent application DE 10 2010 022 418 is particularly respected in the scope of the present invention, on consideration of this situation.

Besides this axial velocity profile averaged in the circumferential direction an impact reduced flow post running zone ("dead water") is determined at each of the radially running vanes of the post guide wheel. In these post running zones the flow increasingly tends to a flow separation from the walls also in a slender diffuser. If a strongly divergent duct extension follows the slender blower diffuser then without suitable medial measures one has to reckon that a flow separation is more likely.

In the following the terms "slender diffuser" and "strongly divergent duct extension" should initially be explained. Duct sections having a reduction of the flow velocity in the main flow direction are referred to as diffusers. For sub-sonic flows the diffusers are characterized by an extension of the flow cross-section in the flow direction. Diffusers can be designed very differently. The simplest case is a centrally symmetric circular areal diffuser which is only composed of a centrally symmetric and spherically divergent outer housing and therefore is carried out without a hub body. For such circularly areal diffusors the degree of slenderness is described by the overall opening angle $2\times\alpha$ of the conical housing. The degree of slenderness and/or the effective opening angle are determined for diffusers having a hub body as follows: The axial extent of the free flow cross-section of the ring space between the hub and the housing is calculated into the axial extent of the cross-section for a circular areal diffuser. This circular areal diffuser is referred to as a replacement circular areal diffuser for the ring diffuser. The opening angle of the replacement circular areal diffuser then serves as a measure for the degree of slenderness. One talks of a slender diffuser generally then, when the replacement circular areal diffuser has an overall opening angle of $2\times\alpha<10°$ up to 20°. The opening angle of the replacement circular areal diffuser is also referred to as an effective opening angle at the diffuser. We talk of a strong duct extension then when $2\times\alpha>15°$ up to 20° up to approximately 120° is true for the effective opening angle and/or for the overall opening angle of the associated replacement circular areal diffuser. Thus there is a boundary region in which the overall opening angle of slender diffusers and strongly extended duct extensions overlap. This depends on the previous history of the flow. When the flow zone in the wall vicinity is already strongly reduced in impact, then a duct having a small effective opening angle already acts like a strong extension and requires corresponding measures for optimizing the recovery of pressure.

For this reason the solution in accordance with the invention includes measures for the optimization of the throughflow of slender diffusers and strongly extended duct sections and therefore of the incoming flow of subsequent components.

For this reason a duct is provided in which a fluid can be guided, wherein the duct is bounded by duct walls, wherein the duct walls have an inlet opening and an outlet opening through which the fluid can enter the duct and exit the duct. The flow has a flow velocity which is smaller along the duct walls than at the duct centre also outside of the direct wall friction layer, so that a zone of higher flow velocity and a zone of lower flow velocity can be formed in the duct, wherein a flow guide surface is arranged in the duct by means of which a portion of the fluid can be taken from the zone of higher flow velocity and can be mixed into the zone of lower flow velocity. The fluid can include a liquid or a gas or a mixture.

The duct walls span a cross-sectional area in accordance with an embodiment wherein the duct has a section whose cross-sectional area increases in the flow direction. In particular the cross-sectional area can be of circular shape or of ring shape.

In accordance with an embodiment a plurality of flow guide surfaces is arranged in the duct. In particular the flow guide surfaces can be arranged adjacent to one another. The flow guide surfaces can be arranged in that section whose cross-sectional area increases in a flow direction.

In accordance with an embodiment the duct is designed as a ring diffuser for an axial blower having post guide vanes. The flow guide surface can, in particular be designed as a guide vane. The guide vanes can include an auxiliary guide vane which extends downstream from the rear edge of the guide vane.

In accordance with an embodiment the section has an opening angle of at least 10°. In particular the section has a first partial section with an opening angle in the range of 10° to 20° at which a second partial section having an opening angle in the range of 15° to 120° can connect.

In accordance with an embodiment at least one hollow body, in particular a radially running wedge-shaped hollow body can be arranged in at least one of the first or second partial sections. Furthermore, a plurality of wedge-shaped hollow bodies can be provided, in particular at least three wedge-shaped hollow bodies can be provided. The effective opening angle in the partial duct between the wedge-shaped hollow bodies can lie in the order of magnitude of 0° to 18°. In rare cases, in particular for a particularly disadvantageous velocity distribution at the inlet into the diffuser also an acceleration of the flow in the partial ducts and/or partial sections of a diffuser with guide surfaces in accordance with the invention can be advantageous. Then the effective opening angle in these partial regions would be negative.

The wedge-shaped hollow bodies can end at a ring which is arranged concentrically in a section configured as a ring-diffuser about its middle axis. A hub can be arranged along the middle axis.

The wedge-shaped hollow bodies can also end at a ring which concentrically surrounds the hub of the ring diffuser. Concentric guide sheet metal parts can be drawn in between the hollow bodies between the middle axis.

In accordance with an embodiment a second fluid can be guided into the duct. In particular the second fluid can be guided into the fluid via nozzles in the vicinity of the flow guide surfaces. The second fluid can then be guided into the hollow bodies, wherein the hollow bodies include openings in order to blow the second fluid into the first fluid.

These embodiments can relate to a slender diffuser which as a rule is arranged directly behind an axial blower. Embodiments are described in the following which can be used in a subsequent strongly extended duct section.

Figure 11:
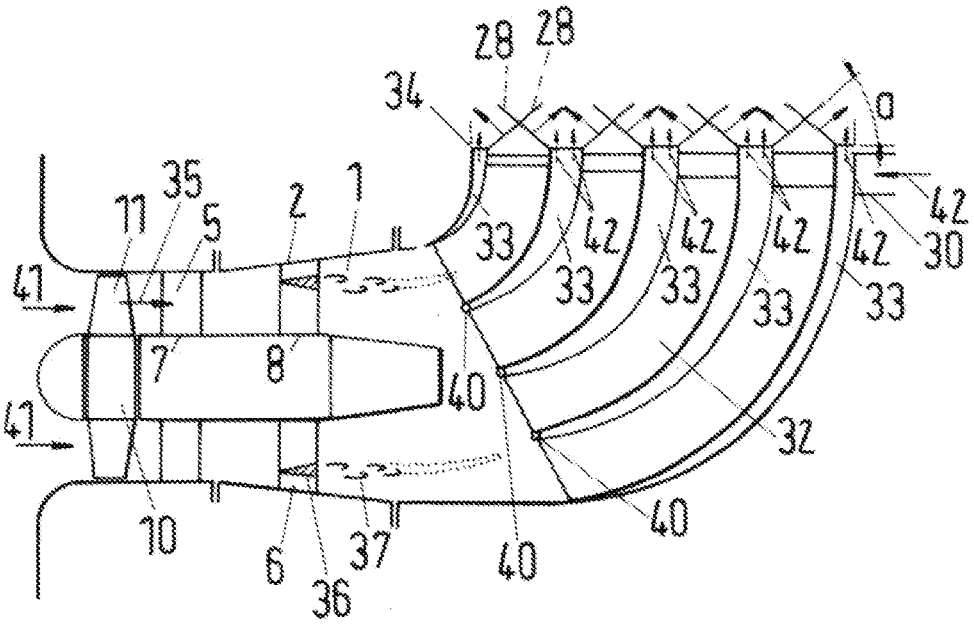

Slender Diffusers:

Due to the previously described situation auxiliary guide vanes are installed in the region close to the separation edge of the blower post guide vanes (rear edge: "trailing edge") in addition to the guide vanes shown in FIG. 4 of DE 10 2010 022 418 and/or FIG. 6 of DE 10 2010 024 091 (FIG. 11). They can be placed at the separation edges of the already present blower post guide vanes, see FIG. 13 and FIG. 16 of the present invention. Principally, however, an attachment of these auxiliary guide vanes at the diffuser wall and/or at the diffuser hub is also possible. These weakly curved auxiliary guide vanes are marginally arranged with regard to the housing wall and/or the hub. Thereby, an impact is injected into the flow boundary layer, in particular in the critical region of the post running dead water of the guide vanes. For this reason, a velocity profile is set at the diffuser inlet which is characterized by a high flow velocity in the wall vicinity. In this respect the wall vicinity velocity maximum can initially be even higher than the velocity in the middle of the ring diffuser, see FIG. 14. It is by all means advantageous when the flow boundary layer mandates a certain impact overshoot, since it must not only withstand the pressure increase at the diffuser, but must also overcome the wall friction forces.

Figure 6:
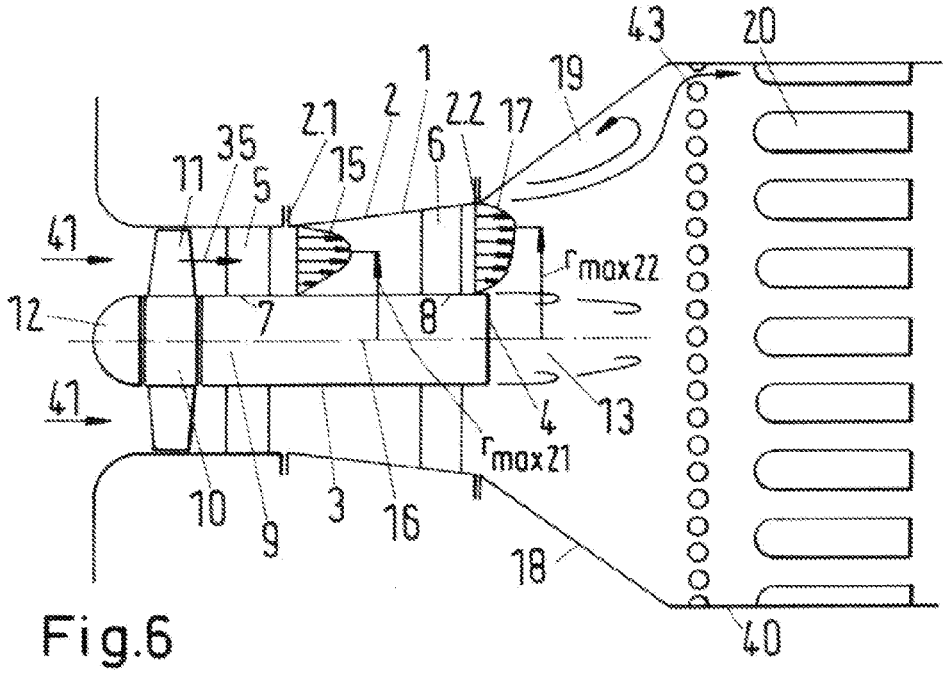
Figure 13:
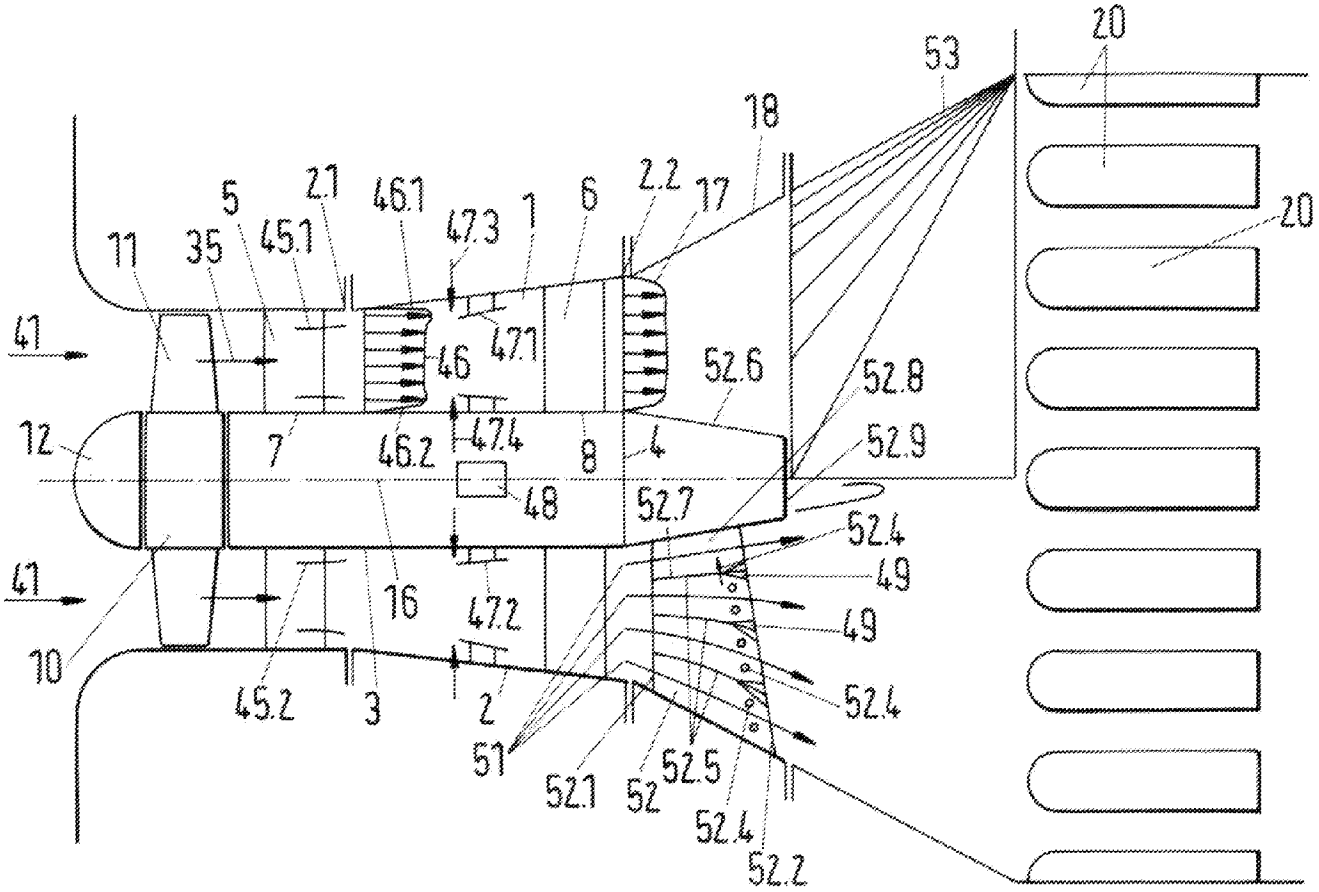

In a further embodiment the guide vanes already illustrated in principle in FIG. 4 of DE 10 2010 022 428 (corresponds to FIG. 4 of the present application) and FIG. 6 of DE 10 2010 024 091 (FIG. 11) are designed as aerodynamically optimized wings, see also FIG. 13. These wings are marginally pitched against the flow so that a not too strong twisting arises here due to the flow separation. In particular a particularly loss making front edge separation of the flow should be avoided. In contrast to the design in accordance with FIG. 4 in DE 10 2010 022 428 the course of the duct between wings and diffuser housing in flow direction is not divergent here, but is rather designed as weakly convergent, since the impact should not be introduced into the region close to the hub for this embodiment, but rather into the boundary layer at the housing wall.

A $1^{st}$ ring of such wings is associated with the housing wall of the diffuser. A $2^{nd}$ ring is associated with the hub of the diffuser, as long as it is a ring diffuser. How large the number of wings should be at the outer ring and at the inner ring can currently not yet be reliably predicted. It could be advantageous to match the number of guide vanes at these rings to the number of post guide vanes of the axial blower. Since a certain amount of damming arises at the front edge of these wing-like guide elements which are positioned in regions of high flow velocity, and therefore evasion flows are also brought about, an over-curvature of the skeletal line of these wings can be advantageous in order to ensure a low loss impact-free inflow. The term over-curvature of a skeletal line known from literature with regard to the aerodynamics of vane grids should now be explained in brief here. The outer contour of a wing can be constructed such that the course of the radiuses of a series of concentric circles, whose middle points lie on the skeletal line is superimposed onto the skeletal line representing a central line of a body. The envelope of the series of concentric circles then forms the contour of the wing. Frequently a wing or a wing-like guide element is arranged such that the tangent at the skeletal line in the region of the sectional nose runs parallel to the direction of the undisturbed inflow $V_\infty$ at an increasing distance from the profile nose. A change of the flow direction is brought about for a convergence at the profile nose and/or the inflow edge by means of the interaction between the guide elements and inflow. The effect of the guide elements on the direction of the inflow can be compensated with the aid of an over-curvature of the skeletal line in order to achieve an as loss-free "impact-free" inflow of the guide element as possible.

Also these wings and/or guide elements can in turn be carried out as turbulent reduced mixer elements. The second fluid to be mixed can be guided via an outer ring line at the side of the wing facing the housing wall, FIG. 14. From this point on it is mixed into the post running flow consciously maintained low in turbulence in this example. Furthermore, the second fluid can also be supplied to the inner ring of wings associated with a hub via the hollow hub. It should be noted with regard to the arrangement of such elements for the homogenization of the velocity distribution in a ring diffuser that these sections remain accessible for inspection at least for large power station blowers.

It is possible to generate a generally homogeneous so-called "block profile" of the velocity distribution at the inlet into the subsequent strongly extended section by means of the combination of the auxiliary guide vanes at the rear edges of the post guide vanes of the axial blower and the guide vanes in the middle region of the longitudinal extent of the diffuser. A considerable additional recovery of pressure in the sense of an increase of the static pressure can already be achieved in a diffuser through the reduction of the over-speed as a consequence of a homogeneous film of the flow cross-section. Furthermore, a considerable recovery of pressure can be achieved for a substantially homogeneous inflow to a strongly extended subsequent duct section which generally connects to the slender blower diffuser also in this connection on the application of the measure in accordance with the invention which is still to be discussed.

In addition the inflow to subsequent components, for example to a profiled sound attenuating inserts or to a flow guide grid in a tube arc can also be significantly homogenized by means of a substantially homogeneous inflow from the strongly extended duct section so that no additional homogenized measures in the form of throttle grids have to be carried out here which would cause a further pressure loss. On the evaluation of the achieved improvements all components contributing to the pressure loss generation of the plant must be taken into consideration.

As a rule, a strongly extending duct section follows the slender blower diffuser which leads to a flue gas passage dimensioned in a common manner or also to a housing in which, for example, profiled sound attenuating inserts can be installed. While the mean flow velocity at the outlet of the diffuser of a large axial blower lies in a region of approximately 40-60 m/s, the mean flow velocities in flue gas passages amount to only approximately 20 m/s. These speed reductions are sensible in order to maintain the flow losses in the flue gas passages and, in particular within duct manifolds within justifiable boundaries. However, if a sound attenuator directly follows an axial blower then the flow velocity in the duct extension must still be reduced further. The profiled sound attenuating inserts cause a cross-sectional blocking of approximately 50%. So that the flow velocity in the relatively long ducts between neighboring links does not become too high, which leads to increased pressure losses, as well as to the generation of noise at the profiled sound attenuating inserts, one reduces the expansion space speed and/or the inflow velocity of the links to approximately 12 m/s. Principally the aim is followed to realize these velocity reductions for total pressure losses which are as low as possible and for an as high as possible gain in static pressure.

Strongly extended duct sections $2\times\alpha>15°$ up to approximately 120°

Measures were already suggested in the German patent application DE 10 2010 024 091 by means of which a delay of the flow in strongly extended duct sections at low total pressure losses and/or at a relevant statistical recovery of pressure could be achieved. For this purpose, displacement bodies were suggested which are designed as centrally symmetrically rings with regard to the main axis and which are thickened up to the rear edge. Such concentric displacement bodies are principally known. An additionally characterizing feature of the design in accordance with the German patent application DE 10 2010 024 091 consists therein that the cross-section between the displacement bodies concentric with regard to the main axis are dimensioned in a certain manner. And indeed the same pressure distribution should be achieved in all partial ducts independent of the speed distribution at the inlet of these components. However, naturally also the question arises with regard to an as simple as possible and therefore cost-effective design of the displacement bodies. The manufacture of concentric rings which are thickened in flow direction is expensive and such components are moreover relatively heavy, so that they can cause problems with regard to the statics.

Furthermore, such concentric displacement bodies which simultaneously carry out the function of guide bodies are described in EP 0789195 A1. The application of such concentric displacement bodies is so far limited to diffusers for airplane turbines or for stationary compact gas turbines. In this respect, the dimensions are comparatively small and the cost of manufacture for such rings does not play a decisive role.

From the striving for the optimization of the overall components concerned, the inventors once again intensively considered an advantageous design of the displacement bodies both in view of aerodynamic aspects and also in view of the manufacturing costs.

In the subsequently described solution it is principally the point that the flow separation can only be avoided then when the cross-section is partially blocked by the displacement bodies for such a large overall opening angle of the strongly extended duct section behind a slender blower diffuser. The flow then exits in the form of individual jets from the intermediate spaces which are set free by the displacement bodies. The delay of the flow velocity is only driven so far that no flow separation takes place in the duct sections. The flow separation is limited to define edges at the outlet of the installations.

Figure 15:
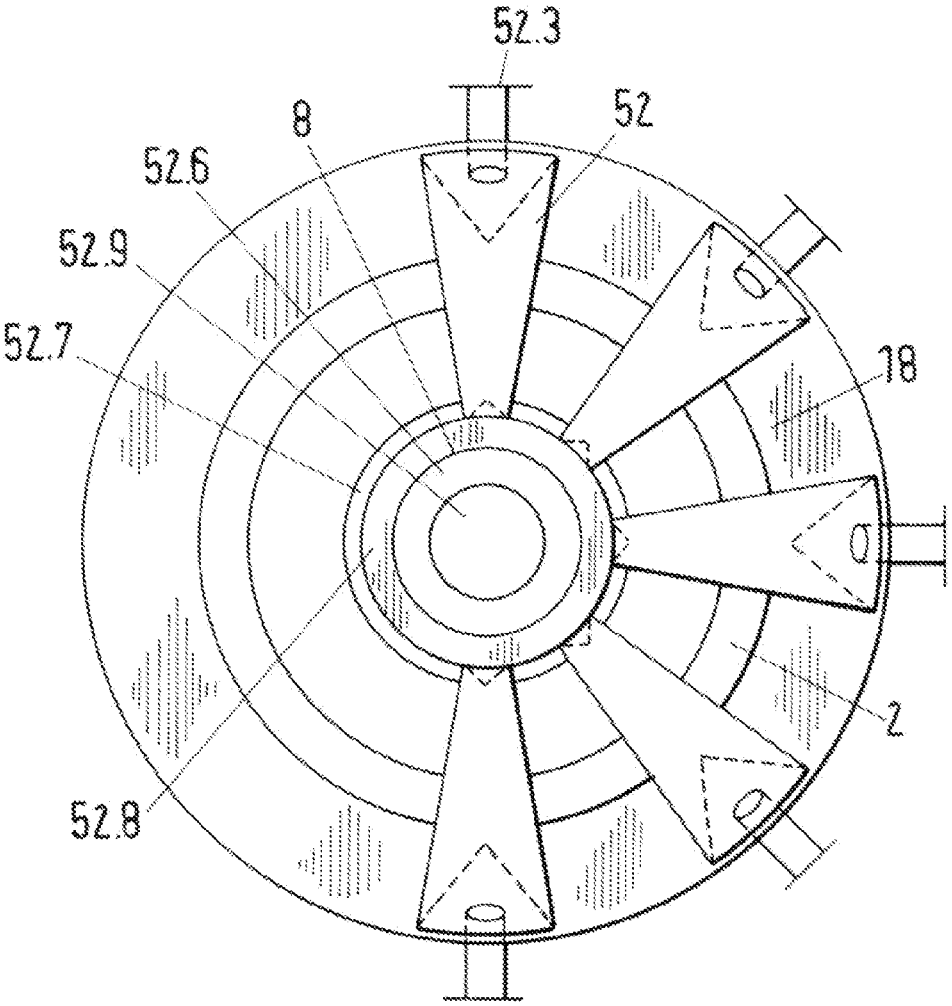

In accordance with the embodiments described here with regard to the basis invention substantially radially running V-shaped gusset plates are installed in the strongly extended duct section instead of concentric displacement bodies as is illustrated in FIGS. 13 and 15 of the present invention. This design in accordance with the invention offers, in particular for the large blowers of power plants having a diffuser diameter of approximately 5 m, decisive advantages with regard to the manufacturing costs. It is generally advantageous to carry out the radially V-shaped gussets not up to the hub body. This would cause too high a cross-sectional blocking in the vicinity of the hub. For this reason it is suggested in accordance with the invention to let the gussets end at an internal ring which is concentric to the diffuser axis which is only connected to the hub via simple radial web plates.

However, when the hub body of the blower diffuser is already supported in the end section of the blower diffuser, a support of the installations in the subsequent strongly increasing duct section towards the hub can be omitted. It would then be centered through the attachment at the housing of the strongly increasing duct section.

Guide vanes can additionally be provided between the V-shaped radial gussets which support a distribution of the flow to the subsequent cross-section. These guide plates are concentric with regard to the diffuser main axis must then, however, not necessarily be designed in flow direction and thus thickened with regard to the rear edge. They can rather be composed of rolled and double-curved thin-walled ring shaped sheet metal part sections which can be manufactured cost-effectively and only cause a small additional weight.

In special cases which require a distribution of the flow into individual jets, however, also both solution approaches can be combined, i.e. the concentric displacement bodies which are thickened towards the rear edge and the radially running V-shaped gusset plates can be combined. In this respect it can be sufficient and even advantageous to install the concentric displacement bodies 49 merely in the end sections of the V-shaped gusset plates.

The radially running gussets which are of hollow design, already for reasons of weight, can be used for the supply of the secondary fluid which should be mixed into the primary fluid. Each gusset would then be associated with an inlet nozzle, FIG. 15. The entirety of the nozzles would then be impinged with the secondary fluid via a ring line not illustrated here.

As is discussed in the associated basic application DE 10 2010 024 091 the invention having the feature of the equal pressure distributor can offer, in particular substantial advantages then when the velocity distribution at the inlet into the strongly divergent section (typical opening angle $2\alpha=90°$) is pronouncedly inhomogeneous behind a normal blower diffuser (typical effective opening angle $2\alpha=12°$). In this case a substantial delay of the impact strong flow would cause such a strong pressure increase that the impact weak zones could not flow up the pressure mountain generated in the mentioned impact strong zones. This would result in a very disadvantageous velocity distribution in the outflow of the strongly extending duct section and thus lead to an unfavorable inflow of a subsequent component.

On the other hand, if the velocity distribution at the inlet into the strongly diverging duct section is substantially homogeneous certainly a certain delay of the flow into all partial ducts can still be sustained. The term "equal pressure" does not relate to the pressure distribution in the flow direction, but rather to the equal running of the pressure increase in the neighboring partial ducts.

Finally, it is dependent on combining all flow technical optimization measures in the slender blower diffuser as well as in a subsequent strongly extended duct section in an advantageous manner in accordance with the invention in the interest of an overall ideal solution and in this respect to take into account predefined boundary conditions from the plant side, in particular also the inflow of subsequent components, such as for example, a sound attenuator or a duct manifold.

In accordance with an embodiment the invention therefore relates to a duct conducting a fluid, in particular a duct conducting the primary fluid, the duct having a more or less strongly pronounced inhomogeneous velocity distribution and/or distribution of the state variables of the primary fluid as well as having a subsequent flow diffuser and possibly a strongly extended duct section connecting thereto, wherein flow guide surfaces are arranged in the duct, through which partial amounts of the primary fluid can be taken from zones having a higher flow velocity and can be mixed into zones of lower flow velocity.

In particular the duct conducting the primary fluid has a circular ring-shaped cross-section and a substantially centrally symmetrical velocity distribution as well as a more or less strongly pronounced velocity maximum, wherein flow guide surfaces are arranged in zones with higher flow velocity in the circular ring-shaped cross-section through which the partial amounts of the primary fluid can be taken and can be mixed in zones of lower flow velocity. The flow guide surfaces can be attached at least to a ring between radially arranged blades.

Furthermore, a ring-shaped duct conducting the primary fluid, in particular a ring diffuser, can be provided which is arranged behind an axial blower having post guide vanes, wherein auxiliary vanes are attached at rear edges of the post guide vanes and/or in the vicinity of the rear edges of the post guide vanes at the housing of the diffuser and/or the hub in zones of higher flow velocity such that partial amounts of the primary fluid can be taken from zones of high velocity and can then be mixed into the slower flow boundary layers at housing and hub.

In accordance with an embodiment the duct is a component of an axial blower having post guide vanes, in particular the duct is a ring diffuser behind an axial blower with post guide vanes. Guide vanes are arranged between the diffuser inlet and the diffuser outlet through which the partial amounts of the primary fluid from the high velocity zones can be fed into slower flow boundary layers.

The ring diffuser behind an axial blower with post guide vanes has a weakly diverging diffuser with an effective opening angle of approximately 10°-18°. A strong duct extension having a geometric opening angle of approximately 15°-120° can be connected to the weakly diverging diffuser. Advantageously, at least 3 hollow bodies can be installed in this duct extension relative to the main axis which are approximately radially aligned and wedge-shaped in flow direction.

The effective opening angle between the wedge-shaped hollow bodies in the partial duct lies in the order of magnitude of approximately 0°-18°. The wedge-shaped hollow bodies can end at a ring which concentrically surrounds the hub of the ring diffuser. Concentric guide sheet metal parts can be drawn in between the hollow bodies towards the diffuser axis.

Guide wings can be arranged between the diffuser inlet and the diffuser outlet through which the partial amounts of the primary fluid from the high speed zones can be injected into the slower flow boundary layers, a secondary fluid can be introduced via nozzles in the close proximity region of the wings into the primary fluid. Furthermore, a secondary fluid can be injected into the wedge-shaped hollow body in an embodiment and from here can be blown into the primary fluid by openings.

In accordance with an embodiment a ring diffuser is provided with a ring of guide elements concentric with regard to the main axis, wherein the concentric ring of guide elements divides the ring diffuser into two rings concentric to one another having comparatively equal area sizes and the guide elements alternatively guide the primary fluid flow outwardly to the housing wall and/or inwardly to the hub.

Figure 5:
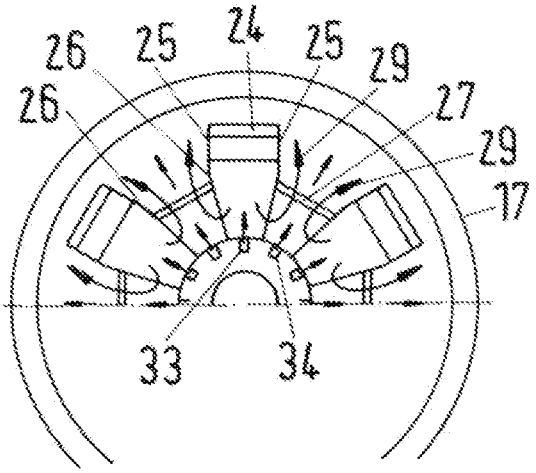
Figure 7:
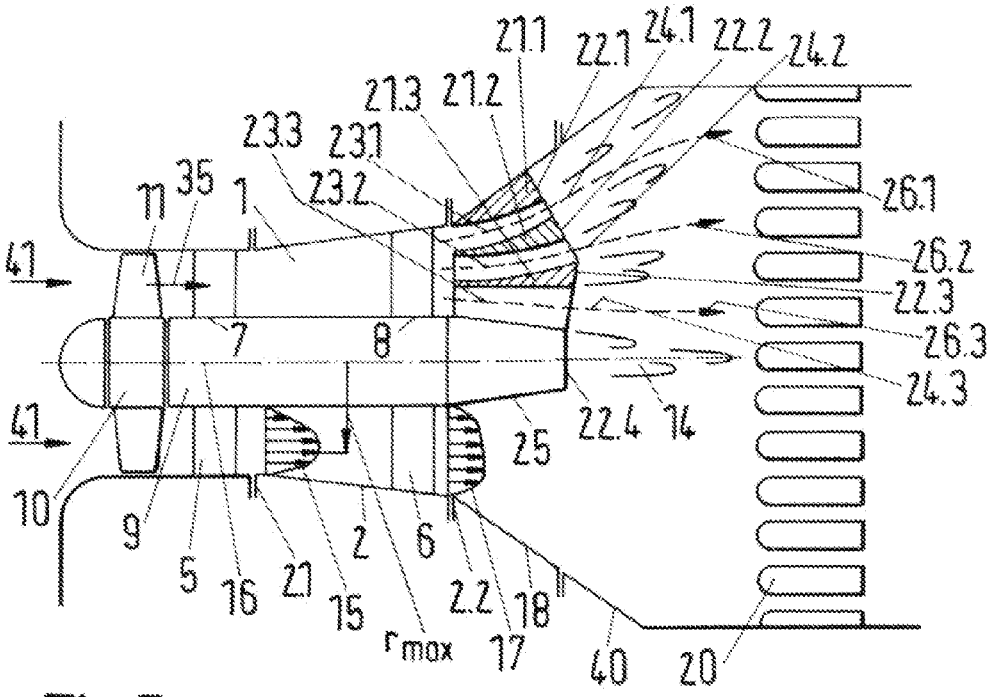
Figure 8:
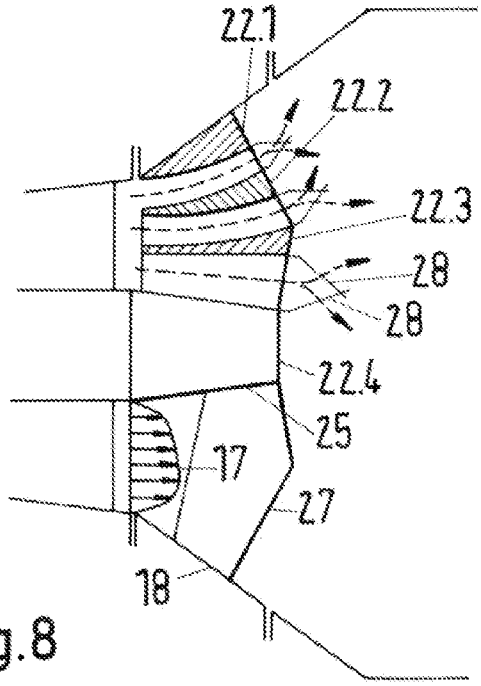
Figure 9:
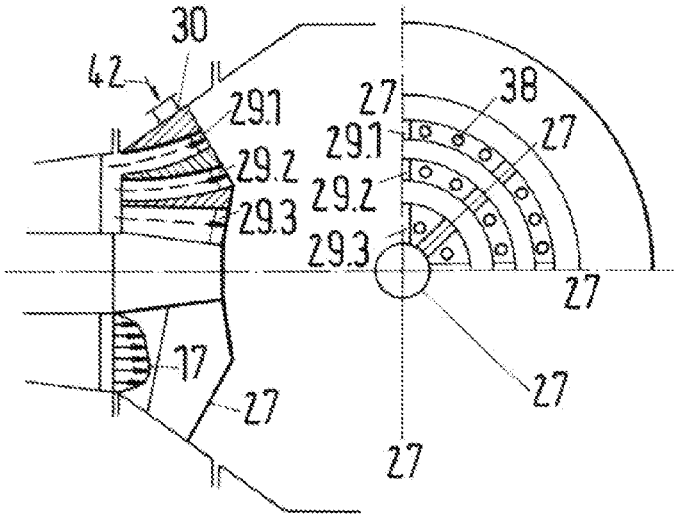
Figure 10:
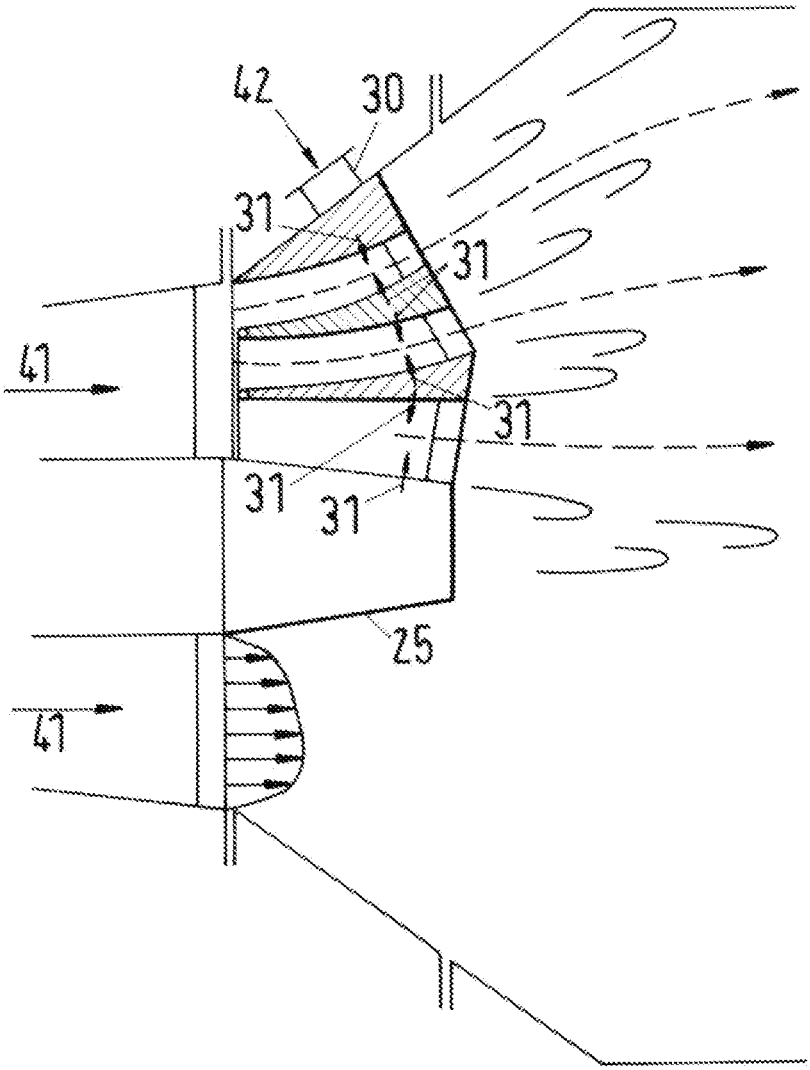
Figure 12:
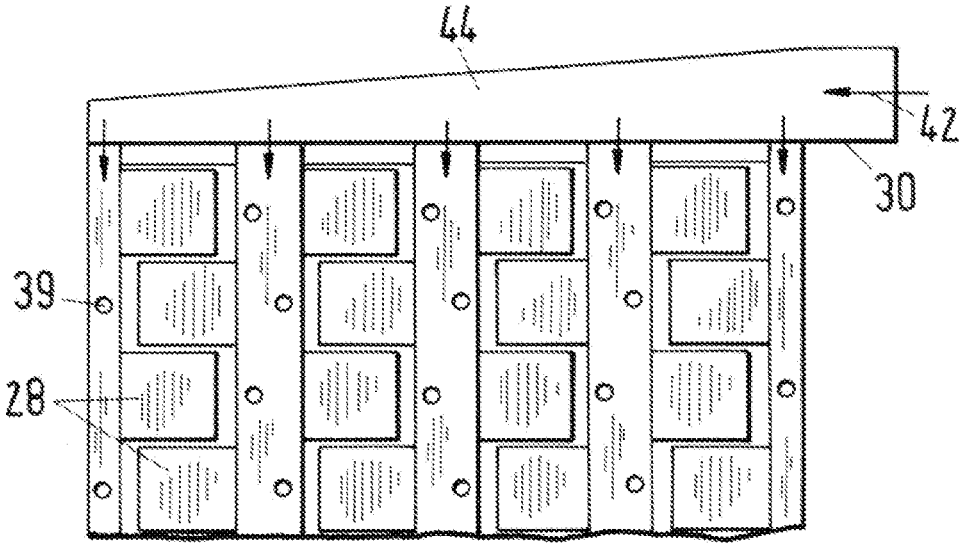
Figure 14:
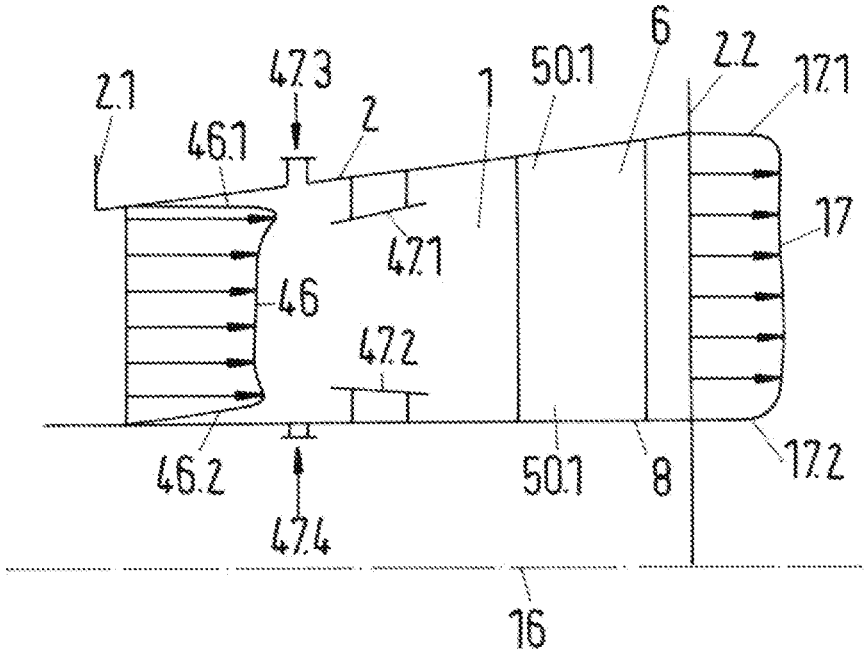
Figure 16:
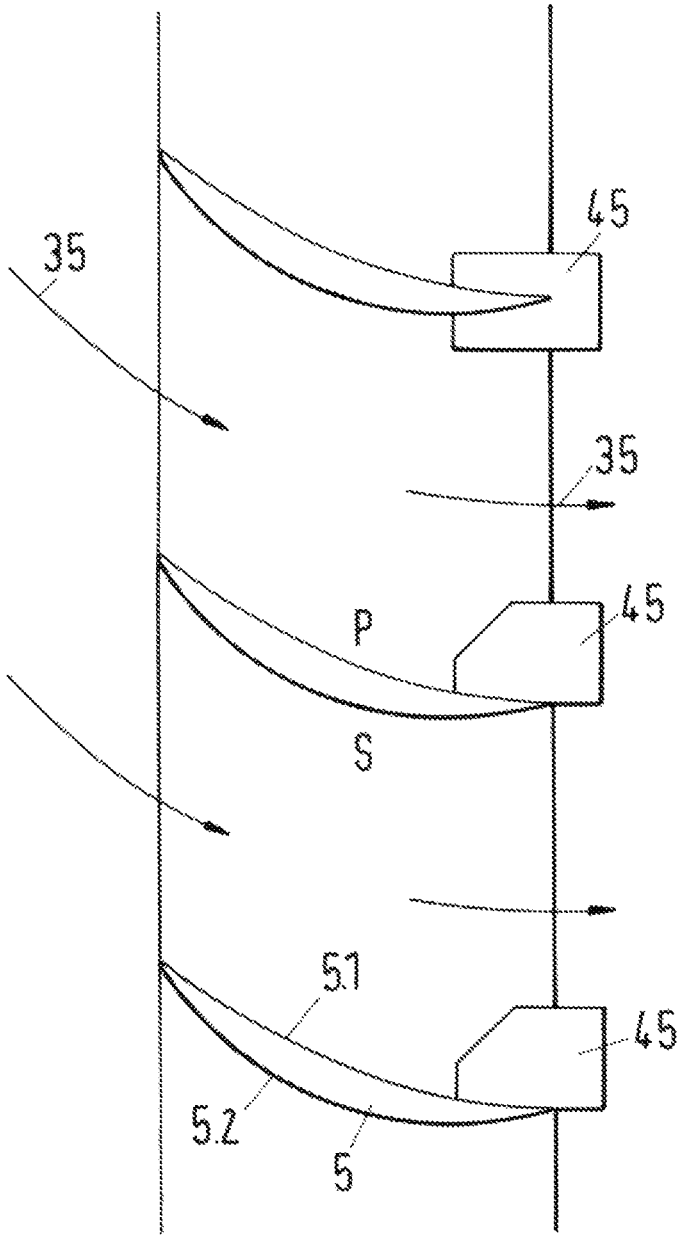
Figure 17:
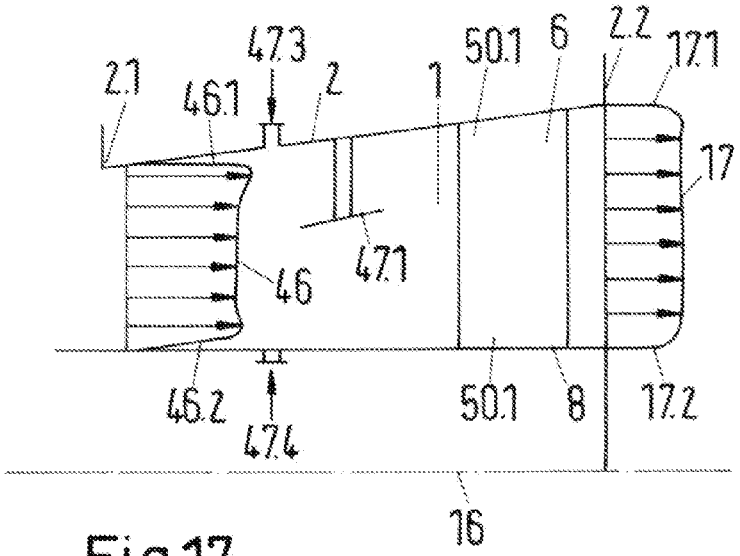
Figure 18:
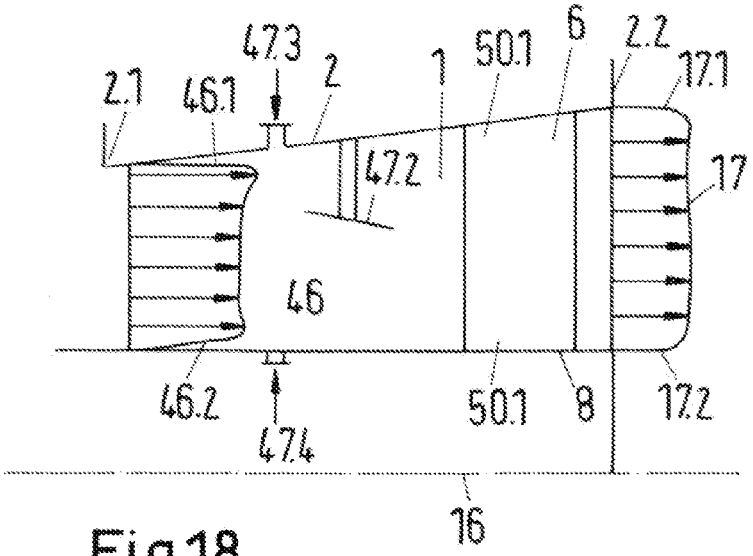
Figure 19:
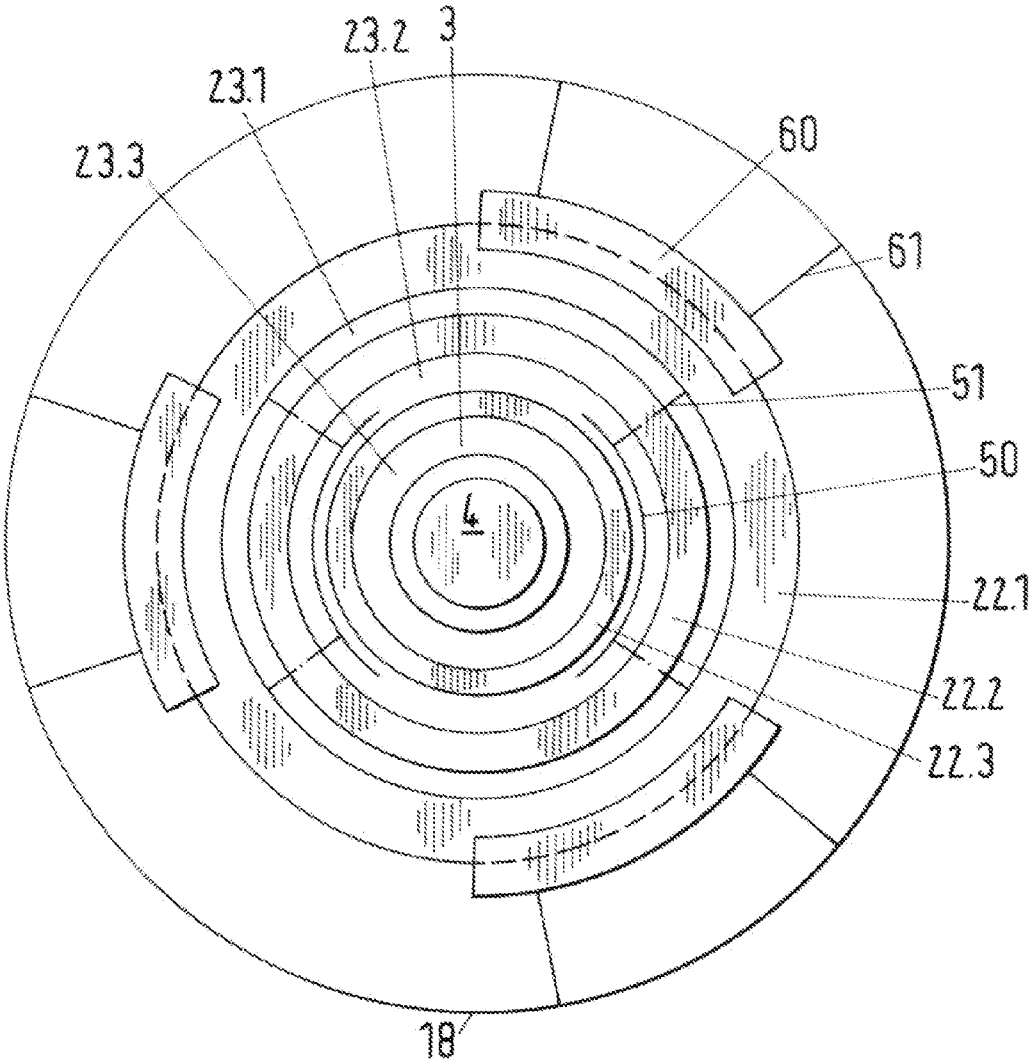

The invention shall be described with reference to the Figures, as shown:

FIG. 1 an axial blower in accordance with the state of the art,

FIG. 2 a section of a ring diffuser in accordance with a further embodiment in accordance with the state of the art, FIG. 3 a section of a ring diffuser in accordance with a further embodiment in accordance with the state of the art, FIG. 4 a section of a ring diffuser in accordance with an embodiment in accordance with the invention, FIG. 5 a radial section through the ring diffuser in accordance with FIG. 4, FIG. 6 an axial blower in accordance with the state of the art having a ring diffuser, duct extension, throttle grid and profiled insert for sound attenuation, FIG. 7 an axial blower in accordance with the invention having ring diffuser, duct extension with equal pressure distributor, as well as with a profiled insert for sound attenuation, FIG. 8 a duct extension in accordance with the invention having ring-shaped equal pressure distributor and mixer elements, FIG. 9 a duct extension in accordance with the invention having ring-shaped equal pressure distributors and displacement bodies at the radial vanes, FIG. 10 a duct extension in accordance with the invention having a ring-shaped equal pressure distributor made of hollow bodies and with hollow displacement bodies at the radial vanes for the supply of the secondary fluid, FIG. 11 an axial blower in accordance with the invention having mixer and guide elements in the ring diffuser, with displacement bodies in a duct extension in the region of a duct manifold, as well as with inlet apparatuses for a secondary fluid and mixer elements, FIG. 12 a top view of the outflow side of the displacement body having mixer elements in accordance with FIG. 11, FIG. 13 an overview drawing having the components of the invention, FIG. 14 a detailed view of FIG. 13 having guide elements at a ring in the vicinity of the housing and at a ring close to the hub, FIG. 15 a view of the outlet of the strongly diverging part upstream, FIG. 16 post guide vanes of the axial blow 5 with additional auxiliary guide vanes, FIG. 17 weakly pitched guide elements at a radius, which divides the overall ring surface of the diffuser into two comparatively equal area rings concentric to one another, FIG. 18 weakly arranged guide elements at a radius which divide the overall ring surface of the diffuser into two comparatively equal area rings concentric to one another, FIG. 19 a variant of FIG. 7.

Solution approaches in accordance with the invention: FIG. 4 and FIG. 5 show a solution approach in accordance with the invention. FIG. 4 represents a longitudinal section through the outlet region of an axial blower 9 having a subsequent ring diffuser 1, FIG. 5 shows a cross-section AB through the front section of the ring diffuser with projection in axial direction. In the middle section of the diffuser, possibly also in the vicinity of the diffuser outlet, wing-like flow guide surfaces 24 are installed. These, however, do not extend as ring guide surfaces over the overall circumference, but respectively only cover shorter sections of the circumference as can be seen from FIG. 5. The flow guide surfaces 24 are equipped with so-called tip wings 25 which dampen the formation of twist tails in the trail of the wing ends as is known from the wings of large airplanes. The wing sections 24 are attached at more or less radially running blades 26 via tip wings such that their angular position $\alpha$ can be adjusted during standstill. The blades 26 are attached at the hub body in this example. However, they can also be mounted at the outer housing 2. Distance holders 27, which can also be carried out wing-like, are attached closer to the hub between the blades for stiffening. Primary fluid is taken from a zone in the region of the velocity maximum 16 by the flow guide surfaces 24 and is deflected towards the hub which projects convergently in two sections 20 and 21. Thereby a hub dead water is filled up which usually arises through flow separation, a flow separation is prevented. A primary fluid flowing slowly from the region in the hub vicinity into the sections 20 and 21 is outwardly displaced, flow line 29 in FIG. 4 illustrated as a dash-dotted line for the correct dimensioning of the guide surfaces under consideration of the velocity distribution 15 at the inlet into the ring diffuser and is mixed there with the partial amounts 30 of the primary fluid flowing along the conical housing.

In a further embodiment a secondary gas-like fluid 32 which should be mixed into the primary gas-like fluid 35 is supplied into the internal space of the hub body 20 and/or 21 via a tube line 31. From here it is blown into the primary fluid via nozzles 33 and 34 at a matched speed, so that it is ideally considered in the mixing process which is generated by the flow guide surfaces.

A further possibility for the mixing of primary and secondary fluid consists therein in carrying out the blades 26 as hollow sections, which are provided with bores at the rear edges via which the secondary fluid can be blown into the primary fluid. Also the wing-like flow guide surfaces can be carried out as hollow sections which are supplied with secondary fluid via the blades 26 which is then blown into and/or mixed into the primary fluid via bores at the rear edges of the guide surfaces 24.

Frequently, the outflow from the running wheel of a blower or compressor still has considerable twist components and/or circumferential components. The flow increasingly tends to a flow separation from the hub for a high circumferential component close to the hub vicinity. A part of the flow energy containing the twist can be recovered by rectification. The blades 26 can serve as rectifier surfaces. It is sensible to curve the front edges of the blades for strongly twisted flows such that a substantially impact-free and thus aerodynamically ideal inflow of the primary fluid is achieved. As a rule it is, however, preferable to design the radius supports 5 in FIG. 1 or FIG. 4 as flow guide sheet metal parts.

Naturally, one could introduce the secondary fluid to be mixed from the outside via bores at the housing instead of via the hollow hub which is not illustrated by way of a Figure here. And when a strong cross-sectional extent with a large opening angle follows the blower diffuser, which is principally carried out with a smaller opening angle, for example, in front of a heat exchanger or in front of a register of profiled sound attenuating inserts, it can be sensible to install additional ring-like guide elements through whose effect the flow field takes on the strong cross-sectional extension without flow separation.

In the following initially the state of the art will be described with reference to FIG. 6 and subsequently by means of embodiments in accordance with the invention with reference to FIGS. 7-12.

STATE OF THE ART

In the following we orientate ourselves on the situation as is present upstream of a large axial blower 9 in accordance with the state of the art which conducts the primary fluid 41, FIG. 6. As a rule, a ring diffuser 1 concentric with regard to the main axis 16 connects to the inflow nose 12 and the blower wheel 10 having the guide vanes 11. In this diffuser the relatively high flow inflow speed 35 of the primary fluid 41 from the axial compressor having a cross-sectional mean value of approximately 80-100 m/s should be reduced on a recovery of static pressure as far as possible and for an as low as possible total pressure loss.

In this example, the ring diffuser 1 is composed of a weakly extending spherically shaped housing 2 and a cylindrical inner body 3, also referred to as hub body, which has a blunt end surface 4, so that in the central region a step like cross-sectional extension is generated in this example which corresponds to a Carnot impact diffuser. The hub dead water 13 is subsequent to the hub body.

The hub body 3 is centered in two axial positions 7 and 8 via more or less star-shaped-radially aligned sheet metal parts 5 and 6. In this respect the sheet metal parts 5 can be carried out as curved post guide vanes of the blower, with the aim to reduce the twist in the coordination of the primary fluid 41 from the guide vanes 11 and thus to achieve a substantially axial through-flow of the subsequent components. The radial sheet metal parts 6 at the diffuser end, sometimes also referred to as blades, are generally carried out without curvature in the axial alignment. In such a ring diffuser, the flow velocity of approximately 80 m/s averaged over the duct cross-section, as is still present behind the running wheel 10 or behind the post guide wheel 5 in section 2.1, is reduced to a mean value of approximately 45 m/s in section 2.2. In particular the velocity distribution 15 shows a pronounced maximum at the diffuser inlet 2.1 which can be displaced to a larger radius $r_{Vmax.\ 2.1}$ for a high aerodynamical load of the axial blower 9 and/or of the running wheel 10. A considerable static recovery of pressure is brought about for only a marginal decrease in total pressure in a weakly loaded diffuser which must be designed with a small opening angle. A velocity distribution 17, which strongly deviates from a block profile whose maximum is also generally displaced outwardly to a larger $r_{Vmax\ 2.2}$; is however, still present at outlet 2.2 of the blower diffuser. With increasing aerodynamic loading of the blower the velocity maximum is generally more strongly pronounced and displaced to a larger radius. This has the effect that subsequent components can be flown at depending on the state of operation of the blower with different velocity distributions.

A flow separation 19 from the duct walls is inevitably brought about by means of the strong cross-sectional increase in the subsequent duct extensions 18 and thus the subsequent components, such as the profiled sound attenuating inserts 20 in the present example, are regionally still flowed at with a very high velocity of primary fluid. This is associated with additional pressure loss as a result of an inhomogeneous through-flow of the register of the profiled sound attenuating inserts as well as having an influence on the attenuation of sound and frequently also with a vibrational excitation which leads to damage at the profiled sound attenuating insert or at other duct installations. In the past homogenizing of the velocity distribution in the strongly diverging duct section and/or in front of profiled sound attenuating inserts 20 was brought about in an approximate manner in that one installed a throttle grid 43 in the extension and/or in the duct 40 in front of the profiled sound attenuating inserts. For the generally short equilibrium path available from the diffuser outlet 2.2 to the profiled sound attenuating inserts 20 it, however, was not possible to achieve a satisfying homogeneous velocity distribution also by means of a throttle grid 43, in any event not when the additional pressure losses should be maintained within allowable boundaries. One should consider here that a pressure loss of 1 mbar, which appears to be small, already results in an additional demand of the blower power of approximately 100 kW for a very high flue gas volume flow of a large power plant block.

Also the installation of thin guide sheet metal parts or slender, wing-like sections, not illustrated here, in the strongly extended duct section 18 does not lead to the desired homogenization of the velocity distribution.

This has been shown in comprehensive investigations of the inventor. A parallel switching of flow diffusers is achieved by the installation of thin guide sheet metal parts. This has negative influences here. A particularly strong increase of the static pressure is achieved in a vaned diffuser in those regions which are flowed at with particularly high velocities. The high static end pressure, which can be achieved in these "strong" regions is impinged on the neighboring zones which are flowed at with low flow velocities and for this reason also with a low dynamic pressure. The dynamic pressure mentioned in the "weak" zones is then, however, not sufficient to mount the pressure mountain impinged by the "strong" zones. Thus a backflow effect on to the flow is carried out in the weak zones by means of the high anti-pressure in the neighboring strong zones. Thereby, the inhomogeneity of the velocity distribution increases and can lead to a backflow in regions which are still flown through with marginal forwardly directed speeds without additional diffuser vanes.

It is the aim of the present invention to reduce the required pressure losses as far as possible which are required for a necessary compensation processes in a strongly extended duct section for a low separation distance to subsequent components, for example a profiled insert for sound attenuation. Furthermore, the possibility should be created in accordance with the invention to mix a secondary fluid 42 in this region into the primary fluid 41, in particular as this can be achieved in the present example with little additional pressure losses. As a distribution grid for the secondary fluid already exists in the extended duct section because of installations to be inserted in accordance with the invention. Naturally one could also inject the secondary fluid into the primary fluid also via a subsequent special mixer. However, such an additional component is expensive and causes additional pressure losses. When such additional pressure losses can be avoided, because the installations for the recovery of pressure into the extended duct take over this task in accordance with the invention behind the axial blower one must evaluate the achieved pressure loss savings by the then possible omission of an additional mixer as a success of the installations in accordance with the invention.

FIG. 7 shows a solution approach in accordance with the invention. It represents a longitudinal section through the outlet region of an axial blower 9 having a subsequent ring diffuser 1, a strongly extended duct section 18 and a register of profiled sound attenuating inserts 20 in a housing 40.

The ring diffuser 1 can be designed in a classical manner or on the basis of the principles in accordance with German patent application DE 10 2010 022 418. Ring-shaped displacement bodies 21.1, 21.2 and 21.3 are installed in the strongly extended duct section 18, which in the present case is designed circular, which at least have a partially slender front edge and a thick outflow side end 22.1, 22.2 and 22.3. The course of the flow cross-sections 23.1, 23.2 and 23.3 between the neighboring rings is dimensioned such that the static pressure in the flow direction remains substantially constant. In this respect we talk of a proximate equal pressure deflection and/or of a proximate isokinetic diversion with distribution of the inhomogeneous flow field still combined at the diffuser outlet 2.2 into individual flow rings. At the outlet of the ring-shaped ducts 23.1, 23.2 and 23.3 volatile cross-section extensions 24.1, 24.2 and 24.3 are provided as is known from Carnot impact diffusers. Even a considerable recovery of pressure is also achieved in these Carnot impact diffusers switched in parallel. The end section of the hub 25 is designed as slightly convergent in this example. This is by no means necessary, but rather depends on the respective installation situation. The recovery of pressure and the homogenizing of the velocity distribution is achieved already for a relatively short running length, however, essentially only starting down-stream of the installations 21 due to the separation of the overall flow field having the velocity distribution 17 into individual more slender ring-shaped zones 23.1, 23.2 and 23.3. The ring-shaped flow fields 26.1, 26.2 and 26.3 at the outlet of the partial ducts 23.1, 23.2 and 23.3 are in this respect aligned such that the inlet surface of the subsequent register of profiled sound attenuating inserts 20 is uniformly supplied with the primary fluid 41.

The following aspect is also important for the understanding of the present invention: In the Carnot impact diffusers 24.1, 24.2 and 24.3, which follow from the equal pressure diversion, an increase of the static pressure is also achieved as is known. This is larger the larger the outlet speed from the partial ducts 24 is. Also this increase of the static pressure is applied to neighboring zones and can lead to a significant throttle effect there. For this reason, a refining of the principle of the equal pressure diversion is to be strived for, also under the inclusion of the effect of the Carnot impact diffusors, in order to generate an as homogenous statistical anti-pressure distribution as possible. In particular for a strongly inhomogeneous velocity distribution 17 at the diffuser outlet 2.2, this may only be achieved under some circumstances by means of additional throttle elements in those duct sections which are flowed at with a high flow velocity and/or with a high dynamic pressure. This shows that it is disadvantageous when the velocity distribution at the outlet of the blower-ring diffuser 1 is already strongly inhomogeneous. The blower-ring diffuser should not be too highly aerodynamically loaded for this reason, since then the velocity profile in the wall vicinity approaches the separation profile having the wall shear stress zero (velocity gradient at the wall=0). As a result a blower diffuser, which is equipped with a convergent hub in addition to an extending housing, is rather disadvantageous in many cases. In contrast to this, however, it can even be of advantage to increase the hub body within the diffuser section 1 in the flow direction a little and to also increase the opening angle of the housing 2 a little. In this manner one can significantly better enable the homogenous flow towards the inflow area of a subsequent register of profiled sound attenuating inserts in a strongly extended duct section. Since the supply paths to the boundaries of the profiled sound attenuating inserts and/or to the central region of the inserts are then of approximately equal length. However, this depends on the dimensions of the inflow area of the profiled sound attenuating inserts in the individual case, as well as on the distance of the insert inlet plane to the installations 21.1, 21.2 and 21.3 which homogenize the flow. And further, also very different installations can follow, whose inflow must satisfy other requirements, so that we do not want to dwell on this problem in any more detail in this connection. It can be advantageous to guide high energetic fluid into zones with low dynamic pressure by means of guide elements instead of the installation of throttle elements in zones with too high a dynamic pressure. Thereby a Venturi pump effect can be achieved by means of which the slow fluid zones are accelerated and can be carried up a pressure mountain. FIG. 8 shows a corresponding design. The deflector plates 28 are mounted at the end surfaces 22.1, 22.2, 22.3 and 22.4 in this example by means of which the flow can be alternatively deflected outwardly and/or inwardly in the circumference direction at the outlet of the ring-shaped ducts 24.1, 24.2 and 24.3, cf. FIG. 7. This is only illustrated in the upper half of the cross-section while in the other lower half the velocity distribution 17 and a radial blade 27 is illustrated. Such radial blades serve for the centering of the ring elements 21, FIG. 7 and FIG. 8.

Such a mixer for partial flows of different velocities (impact mixer) naturally also offers very good prerequisites for the mixing of the secondary fluid 42 into the primary fluid 41. Here a combination of the variants in accordance with FIG. 8 and FIG. 10 can be provided.

The ring-shaped installations 21.1, 21.2 and 21.3 in FIG. 7 are typically centered via radial blades 27. However, a still not sufficient flow dynamic decoupling of the partial flows 26.1, 26.2 and 26.3 can be achieved by means of this measure alone in some cases. These ring-shaped partial flows have the tendency to undergo a transient interaction with one another. This can be strongly damped by the deflector plates in accordance with FIG. 8. A further possibility of damping is illustrated in FIG. 9 in section (left) and in a view of the outflow side (right). In this example outlet side displacement bodies 29.1, 29.2 and 29.3 are installed between the rings 21.1, 21.2 and 21.3, FIG. 7, and towards the hub 25, which should be effectively mounted onto the already discussed radial blades 27. Substantially closed flow rings are divided into ring sections by means of these displacement bodies which tend to less strong interactions.

The problem of mixing a secondary fluid 42 into the primary fluid 41 is also solved in accordance with the invention by means of an equal pressure diversion in accordance with FIG. 9. The secondary fluid 42 is guided via a duct line 30 as well as via the displacement bodies 29.1, 29.2 and 29.3 of hollow design, cf. FIG. 10, into the ring elements 21.1, 21.2, 21.3 of hollow design and into the hub body 25, FIG. 7. The secondary fluid 42 enters into the primary fluid 41 via openings 31 from the rings 21.1, 23.2, 21.3 as well as from the hub body 25. The mixing process can be strongly fanned by deflector plates 28 which are attached at the outlet side at the ring elements of the equal pressure diversion in accordance with FIG. 8 and which divert the primary fluid beams 26.2, 26.2 and 26.3 from the intermediate spaces 23.1, 23.2 and 23.3 alternatively to the outside, this means to larger radii and towards the inside. Thereby both the problem of a homogenizing flow for low pressure losses and/or even for a recovery of static pressure and also the mixing of a secondary fluid can be effected by means of this equal pressure diversion in accordance with the invention. In contrast to this, if one takes the problem of the mixing of a secondary fluid from the task of the invention and associates this with a separate mixer component, then this is in any case connected to an additional pressure loss as well as to additional investment cost.

The previously described mechanisms and solution principles can naturally also be applied to different configurations as such, as is, for example, illustrated in FIG. 11. For example, it is very advantageous in accordance with the invention to equip a manifold 32 having vanes with guide bodies 33 which have a thickened outflow side 34, in particular then when this has a cross-sectional extent in the flow direction. Also an equal pressure diversion with subsequent Carnot impact diffuser can be generated by means of the hereby connected displacement effect. In this example it can even be advantageous to carry out the thickening a little more pronounced than would be necessary for a consistent flow cross-section between the guide bodies. A flow separation at the suction side of the deflection vanes is then also avoided when a strong deflection about, for example 90° should be realized by means of the acceleration which is inherent with the cross-sectional reduction in the flow direction for subsonic flows.

Naturally, all principles described in connection with the ring-shaped equal pressure diversion, in particular also the measures for the mixing of the secondary fluid, also in a duct diversion can be utilized. For this purpose the diversion vanes 33 are of hollow design and are connected to the supply of the secondary fluid to be mixed via a nozzle 30, as is illustrated in FIGS. 11 and 12. Deflector vanes 28 can also be installed which cause an intensification of the mixing at the outflow side end faces 34 of the frame of diversion vanes 33. For a very inhomogeneous inflow to the grid of diversion vanes 33 it can be sensible to match the configuration of the deflector vanes 28 to the local situation, such that a homogenization of the through-flow or at least a homogenization of the outflow from the deflection grid to the neighboring components is caused. For this purpose, the pitch angle $\alpha$ of the deflector blades 28 can be varied from position to position in accordance with the invention. A stronger local throttling of the flow of the primary fluid is brought about as well as an intensification of the mixing into neighboring zones for the decreasing angle $\alpha$. When no secondary fluid 42 should be mixed into the system having the deflector vanes 28, the system acts as a mixer and a homogenizing component within the primary fluid 41.

Guide surfaces 36 are also drawn into the blower diffuser 2 in FIG. 11, as was already suggested by the same inventor in an earlier German patent application DE 10 2010 022 418, see FIG. 1 to FIG. 5. Hereby a homogenization of the outflow from the ring diffuser can be achieved and this is of considerable advantage for the through-flow of the subsequent manifold.

FIG. 12 shows, partly in section, a top view onto the outflow sides 34 of the guide vanes 33. In this example the deflector blades 28 which are alternatively angled to the left and/or to the right can be recognized as well as the associated outblow bores 39 for a secondary fluid 42. The supply duct 44 for the secondary fluid 42 is arranged outside of the manifold in this connection.

FIG. 13 of this invention represents an overview drawing. In particular it also shows the additional functional elements in comparison to the earlier application of the inventors. In this respect a first ring 45.1 of auxiliary guide vanes 45 is attached in the vicinity of the housing outer wall at the post guide vanes 5 of the blower. A second ring 45.2 of the auxiliary vanes 45 is arranged in the vicinity of the hub 7 at the same post guide vanes. Typically of the order of magnitude of 20 post guide vanes are present. An acceleration of the flow fields in the wall vicinity and/or the flow boundary layers is caused by the auxiliary guide vanes which are pitched slightly to the respective walls without a relevant flow separation being brought about and thus to considerable pressure losses having to be brought about. The auxiliary vanes can, for example, be attached at the pressure side 5.1 of the guide vanes 5 or both at the pressure side 5.2 and also at the suction side 5.1, cf. the detailed illustration in FIG. 16. Since these auxiliary guide vanes are arranged in zones with high flow velocity they must naturally be designed as aerodynamically optimized wings.

The effect of these auxiliary guide vanes is shown in a velocity profile in accordance with item 46 having large velocity gradients 46.1 at the housing wall and/or at the hub 46.2. It can even be advantageous to generate a zone with slightly higher flow velocities in the wall vicinity than in the duct middle, as is illustrated for the velocity profile 46 in FIG. 13.

A ring 47.1 of individual guide vanes only slightly pitched against the flow is arranged in the middle section of the divergent housing 2 of the ring diffuser 1 at the interior wall. A corresponding ring 47.2 of guide vanes is attached at the hub 3. The guide vanes at both rings could also be designed as delta wings 48. As a rule we would, however, not use delta wings, but rather wing sections having a defined front edge which lie at a concentric ring which is approximate to the diffuser axis. The wing sections can advantageously be equipped with "tip wings", whereby the boundary twist formation and thus the pressure loss is reduced, as was already suggested in the application DE 10 2010 022 418. Each wing produces an impact flow directed into the flow boundary layer by means of the light pitch against the inflow.

Basically, also several rings of guide vane elements and/or guide wings can be attached at different axial positions of the ring diffuser. A substantially homogeneous velocity profile 17 is generated in cross-section 2.2 at a diffuser end, which is characterized, in particular by strong velocity gradients in the region 17.1 and 17.2 in the low vicinity by means of the measures in the form of the auxiliary guide plates 45.1 and 45.2 at the rear edges of the post guide vanes 5 of the blower as well as the guide vanes 47.1 and 47.2 in the diverging section of the ring diffuser 1. A substantially homogeneous inflow 51 to the subsequent components, in the present case a profiled insert for sound attenuation 20, can be achieved on the basis of such a velocity profile for minimum total pressure losses and for an as good as possible recovery of static pressure in the subsequent strongly extended section 18 by means of suitable installations. Wedge-shaped hollow bodies and/or V-shaped gusset plates 52 are provided as installations here having a radially aligned and relatively sharply running inflow and/or front edge 52.1. The V formed by the gusset plates need not necessarily be closed at the rear edge. When a high dust load in the fluid is present it can, however, be sensible for the avoidance of dust collections to carry out the gusset plates as hollow bodies and to provide a rear cover plate 52.2, cf. also FIG. 13.

In this case the gusset plates form the radially running hollow bodies to which a second fluid can be supplied via individual nozzles 52.3 as long as such a mixing of, e.g. warm air is required. The second fluid can be guided via bores 52.4 into the primary fluid flow. Additional guide vanes 52.5 are arranged between the gusset plates. The gusset plates 52 end at a concentric ring 52.7 which simultaneously illustrates the guide element 52.5 closest to the hub. Ring 52.7 is supported via radial blades 52.8 towards the hub 52.6. The concentric guide plates 52.5 are illustrated between the V-shaped gusset plates with a thickened rear edge 49 in FIG. 13. This solution represents a combination of the two different concepts of how to avoid a flow separation in a strongly extended duct section; in the present example the V-shaped radially running gusset plates 52 are combined with displacement bodies 49 concentric with regard to the main axis 30 and thickened with regard to the rear edge.

Several possibilities exist for the introduction and mixing of a secondary fluid (for example hot air or ammonia) into the primary fluid.

The nozzles 47.3 and 47.4 are arranged in close spatial arrangement to the guide vanes 47.1 and 47.2 for the introduction of the secondary fluid in FIG. 14. The primary fluid is mixed into the partial flows taken with little turbulence. Since the generation of a highly turbulent flow is omitted with a view to the minimization of the pressure losses in this invention, a larger running path is required for the mixing of the secondary fluid.

The principle of the introduction of a secondary fluid into the primary fluid via the wedge-shaped hollow body 52 is illustrated in FIG. 15, which represents an illustration in the viewing direction upstream to the main flow of the primary fluid 41. Each hollow body 52 is associated with an inlet nozzle 52.3. The outlet bores 52.4 for the secondary fluid are only represented figuratively in FIG. 13. FIG. 13 also shows the end surfaces 52.9 of the hub body 52.6 as well as radial web plates 52.8 via which the ring 52.7 is supported towards the hub 52.6.

FIG. 17 and FIG. 18 show a special case of configuration in accordance with FIG. 13 or FIG. 14. Weakly pitched guide elements are approximately arranged at a ring concentric with regard to the main axis 16 at the blower diffuser in this case by means of which the primary fluid is guided alternatively outwardly to the housing wall and/or towards the interior towards the hub. In this respect the guide elements 47.1 and 47.2 can be carried out in different sizes. The radius of the ring concentric to the main axis 16 at which the guide elements are arranged is dimensioned such that the primary fluid flow is approximately divided into two equal sized volume-partial flows. In particular for an inhomogeneous velocity profile of the primary fluid it can, however, also be advantageous to dimension the radius of the ring such that it divides the primary air flow into two approximately equal-sized impulse-partial flows.

FIG. 19 shows a variant of FIG. 7. In accordance with this variant, a segmentation of the ring duct and/or the duct extension can be provided in the ring diffuser 1 or in the subsequent duct extension 18. The segmentation takes place via duct segments which are connected with the inner wall of the ring diffuser 1 or the inner wall of the duct extension 18 via radial supports 51, 61. The duct segments 50, which can be present in the ring diffuser 1 between its inner wall and the hub 3 can be configured in cylinder segments. Alternatively, they can also be designed parallel to the interior wall of the ring diffuser and thus as segments of a cone.

The duct segments 60 which are present in the duct extension down-stream of the ring-shaped displacement bodies 21.1, 21.2 and 21.2 can also be designed as segments of a cone. The pitch of the cone can correspond to the pitch of the duct extension forming the cone, but can also be larger or smaller depending on the desired influence of the fluid flow by means of the duct extension.

NOMENCLATURE (WITH FIG. 6 TO FIG. 18)

1 ring diffuser
2 housing of the ring diffuser
2.1 inlet plane to the ring diffuser
2.2 outlet plane of the ring diffuser
3 hub of the ring diffuser
4 end surface of a cylindrical ring diffuser
5 post guide vanes of the blower and/or radial blades at the beginning of the hub
6 radial blades in the end section of the hub
7 front section of the hub
8 rear section of the hub
9 axial blower
10 rotor of the axial blower
11 guide vanes of the axial blower
12 inflow nose of the axial blower
13 post guide dead water behind the cylindrical nose
14 post guide dead water between a weakly converging hub
15 velocity distribution in 2.1
16 axis of the ventilator
17 velocity distribution in 2.2
18 strongly diverging housing section, preferably circular
19 flow separation area in 18
20 profiled sound attenuating inserts
21 ring-shaped installation in 18
22 outflow end surfaces of the installations 21
23 ring-shaped ducts between the installations 18 as well as the hub
24 Carnot impact diffuser
25 weakly converging hub section
26 inflow of the profiled sound attenuating inserts
27 radial blades
28 deflector plates
29 displacement body between the ring-shaped installations and the radial blades
30 inlet nozzles for the secondary fluid
31 inflow of the secondary fluid into the ducts 23
32 manifold
33 hollow guide body in the manifold
34 end surfaces of the hollow body-guide body 33
35 flow of the primary fluid in the axial blower
36 displacement body with guide effect in the ring diffuser
37 post guide dead water behind the installations 18 in the ring diffuser

38 outflow of the primary fluid 41 between the installations 18
39 outflow bores for the secondary fluid 42 at the outflow side end surfaces 34 of the installation 33
40 rounded inflow noses of the guide bodies 33
41 primary fluid flow
42 secondary fluid flow
43 throttle grid
44 supply duct for the secondary fluid 42
45 auxiliary guide vanes
45.1 auxiliary guide vanes in the housing wall vicinity
45.2 auxiliary guide vanes near the hub 7
46 velocity profile behind the post guide vanes with auxiliary blades in the vicinity of the diffuser inlet 2.1
46.1 velocity profile with large velocity gradients at the housing wall
46.2 velocity profile with large velocity gradients at the hub
47 guide vanes in the middle section of the ring diffuser
47.1 guide vanes at the housing
47.2 guide vanes at the hub
47.3 nozzles for the inlet of a secondary fluid from the housing
47.4 nozzles for the inlet of a secondary fluid from the hub
48 guide plate in the form of a lightly pitched wing
49 thickened rear edge section of the guide vane 52.5
50.1 flow boundary layer near the housing wall
50.2 flow boundary layer at the hub
51 outflow of the strongly diverging section 18 and/or inflow to the profiled sound attenuating inserts 20
52 wedge-shaped hollow body and/or gusset plates
52.1 front edge and/or inflow edge of the gusset plates
52.2 cover plate of the wedge-shaped hollow body at the outflow side end
52.3 nozzle for the introduction of a secondary fluid into the hollow body 52
52.4 bores for the introduction of the secondary fluid into the primary fluid flow
52.5 guide vanes between the gusset plates
52.6 hub in the strongly diverging section 18
52.7 ring concentric to the hub 52.6
52.8 radial support plates between the hub and the ring 52.7
52.9 end surface at the hub section 52.6
53 transition from the circular strongly diverging section 18 to the rectangular installation section of the profiled sound attenuating inserts 20

The invention claimed is:

1. A duct section flowed through by a primary fluid having a cross-sectional expansion in the flow direction as well as having installations through which the duct cross-section is divided into at least a two part duct, the duct section comprises a blower diffuser having an opening angle in the range of 10° behind which an extended duct section having an opening angle in the range of 20° to 120° is connected, wherein the installations are V-shaped gusset plates in the extended duct section, wherein the V-shaped gusset plates are arranged in a radial array about the middle axis of the extended duct section and cross through the flow path of the primary fluid, and wherein the cross sectional thickness of the V-shaped gusset plates increase along the flow path of the primary fluid.

2. A duct section in accordance with claim 1, characterized in that the V-shaped gusset plates are designed as wedge-shaped bodies.

3. A duct section in accordance with claim 2, wherein the wedge-shaped hollow bodies end at a ring which is arranged concentrically in a section configured as a ring diffusor about its middle axis.

4. A duct section in accordance with claim 3, wherein a hub is arranged along the middle axis.

5. A duct section in accordance with claim 4, wherein the wedge-shaped hollow bodies end on a ring which concentrically surrounds the hub of the ring diffusor.

6. A duct section in accordance with claim 3, wherein concentric guide sheet metal parts are drawn in between the hollow bodies towards the middle axis.

7. A duct section in accordance with claim 1, wherein the V-shaped gusset plates are of hollow design and are provided with a secondary fluid from the outside via pipe lines; and in that the secondary fluid is blown into the primary fluid for the purpose of mixing via bores in the surface of the installations.

* * * * *

UNITED STATES PATENT AND TRADEMARK OFFICE

CERTIFICATE OF CORRECTION

PATENT NO. : 9,291,177 B2
APPLICATION NO. : 13/701751
DATED : March 22, 2016
INVENTOR(S) : Dieter Wurz et al.

It is certified that error appears in the above-identified patent and that said Letters Patent is hereby corrected as shown below:

In the Claims

Column 22, Claim 1, Line 11 should read -- ... of 10° to 20° behind which an extended duct section having an ...

Column 22, Claim 3, Line 24 should read -- ... wedge shaped bodies end at a ring which is arranged ...

Signed and Sealed this
Twenty-fourth Day of May, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,291,177 B2
APPLICATION NO. : 13/701751
DATED : March 22, 2016
INVENTOR(S) : Dieter Wurz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 405 days.

Signed and Sealed this
Second Day of August, 2016

Michelle K. Lee

Michelle K. Lee
*Director of the United States Patent and Trademark Office*